US009875885B2

(12) United States Patent
Remes et al.

(10) Patent No.: US 9,875,885 B2
(45) Date of Patent: Jan. 23, 2018

(54) SYSTEMS AND METHODS FOR ION ISOLATION

(71) Applicant: Thermo Finnigan LLC, San Jose, CA (US)

(72) Inventors: Philip M. Remes, San Jose, CA (US); Jae C. Schwartz, Gilroy, CA (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 14/709,387

(22) Filed: May 11, 2015

(65) Prior Publication Data

US 2016/0336164 A1 Nov. 17, 2016

(51) Int. Cl.
*H01J 49/42* (2006.01)
*H01J 49/00* (2006.01)

(52) U.S. Cl.
CPC ..... *H01J 49/427* (2013.01); *H01J 49/0027* (2013.01); *H01J 49/0031* (2013.01); *H01J 49/423* (2013.01); *H01J 49/4205* (2013.01)

(58) Field of Classification Search
CPC ..... H01J 49/428; H01J 49/427; H01J 49/423; H01J 49/0027
See application file for complete search history.

(56) References Cited

U.S. PATENT DOCUMENTS 4,761,545 A * 8/1988 Marshall ..... H01J 49/38 250/282
5,134,286 A 7/1992 Kelley
5,324,939 A * 6/1994 Louris ..... H01J 49/428 250/291
5,572,025 A * 11/1996 Cotter ..... H01J 49/0009 250/282
6,633,033 B2 10/2003 Yoshinari et al.
7,378,648 B2 * 5/2008 Wang ..... H01J 49/424 250/281
7,928,373 B2 4/2011 Quarmby et al.
8,395,112 B1 3/2013 Bier
2004/0245461 A1 12/2004 Senko
2006/0038123 A1 * 2/2006 Quarmby ..... H01J 49/427 250/292

(Continued)

FOREIGN PATENT DOCUMENTS

EP 0362432 A1 4/1990
WO 97/44814 A1 11/1997

(Continued)

OTHER PUBLICATIONS

Soni, et al., "Selective Injection and Isolation of Ions in Quadrupole Ion Trap Mass Spectrometry Using Notched Waveforms Created Using the Inverse Fourier Transform," Analytical Chemistry, vol. 66, No. 15, 1994, pp. 2488-2496.

*Primary Examiner* — Wyatt Stoffa
(74) *Attorney, Agent, or Firm* — David A. Schell

(57) ABSTRACT

A mass spectrometer includes a radio frequency ion trap and a controller. The controller is configured to cause an ion population to be injected into the radio frequency ion trap and supply an isolation waveform to the radio frequency ion trap. The isolation waveform has at least one notch at a target mass-to-charge ratio and a frequency profile determined to eject unwanted ions at a plurality of frequencies in a substantially similar amount of time.

18 Claims, 11 Drawing Sheets

(56) References Cited

U.S. PATENT DOCUMENTS

| | | | | |
|---|---|---|---|---|
| 2007/0084994 | A1* | 4/2007 | Wang | H01J 49/424 250/282 |
| 2007/0164208 | A1* | 7/2007 | Quarmby | H01J 49/427 250/282 |
| 2009/0194688 | A1* | 8/2009 | Bateman | H01J 49/4215 250/292 |
| 2010/0084547 | A1* | 4/2010 | Pringle | H01J 49/428 250/282 |
| 2011/0012013 | A1* | 1/2011 | Remes | H01J 49/0009 250/252.1 |
| 2012/0049059 | A1* | 3/2012 | Taniguchi | H01J 49/428 250/290 |
| 2013/0299693 | A1* | 11/2013 | Xia | H01J 49/0063 250/283 |
| 2014/0339421 | A1* | 11/2014 | Senko | H01J 49/0081 250/283 |
| 2015/0206733 | A1* | 7/2015 | Murphy | H01J 49/428 250/282 |
| 2016/0020083 | A1* | 1/2016 | McAlister | H01J 49/428 250/283 |

FOREIGN PATENT DOCUMENTS

| | | | |
|---|---|---|---|
| WO | 2007/040924 | A2 | 4/2007 |
| WO | 2012/051392 | A2 | 4/2012 |
| WO | WO 2013/112677 | A2 | 8/2013 |
| WO | 2014/159478 | A1 | 10/2014 |

* cited by examiner

SYSTEMS AND METHODS FOR ION ISOLATION

FIELD

The present disclosure generally relates to the field of mass spectrometry including systems and methods for ion isolation.

INTRODUCTION

Tandem mass spectrometry, referred to as MS/MS, is a popular and widely-used analytical technique whereby precursor ions derived from a sample are subjected to fragmentation under controlled conditions to produce product ions. The product ion spectra contain information that is useful for structural elucidation and for identification of sample components with high specificity. In a typical MS/MS experiment, a relatively small number of precursor ion species are selected for fragmentation, for example those ion species of greatest abundances or those having mass-to-charge ratios (m/z's) matching values in an inclusion list.

Ion isolation in the field of mass spectrometry is the process of removing unwanted/interfering ions from a sample to be analyzed, while retaining those ions that are desired for further processing and/or analysis (precursor ions). In the context of isolating ions in ion traps utilizing nominally quadrupolar potentials, much work has been done related to procedures for ion isolation via application of broadband supplementary ac waveforms. See, for example, U.S. Pat. Nos. 4,761,545, 5,324,939, and 5,134,286 The broadband supplementary ac waveforms can have a frequency profile containing energy at the oscillation frequencies of the unwanted/interfering ions, and no energy at the oscillation frequencies of the precursor ions, forming a "notch". The construction of these waveforms has been widely studied and used, and is well known in the art.

However, relatively less attention has been given to the description of the optimal amplitude scaling of the individual frequency components, i.e. the ideal frequency profile of the isolation waveform. In general, the waveform frequency response should eject all unwanted ions, of all m/z values at their respective q (or frequency) values, in the substantially the same amount of time. This is especially important when ion isolation is to be performed simultaneously for multiple precursors, (see U.S. Patent Publication No. 2014/0339421), since an inappropriate waveform frequency response will lead to irregular isolation efficiency as a function of precursor oscillation frequency (i.e. m/z), and/or other complications.

Simultaneous multiple precursor selection was described by Cooks and coworkers (Analytical Chemistry, Vol. 66, pg. 2488, 1994) where it was reported that the waveform frequency response should mirror the strength of the pseudopotential well, and therefore the lower frequencies should have less amplitude than the higher frequencies. For example, in their experiment, the waveform had amplitude 2.34 V at q=0.07, and amplitude 11.6 V at q=0.40. While this frequency response may have been an acceptable approximation over that range of q values, its description ignores the m/z dependence of the amplitude required to eject an ion in a given amount of time, and furthermore it does not teach what the waveform frequency response should be for higher q values.

From the foregoing it will be appreciated that a need exists for improved methods for ion isolation in mass spectrometry.

SUMMARY

In a first aspect, a mass spectrometer can include a radio frequency ion trap and a controller. The controller can be configured to cause an ion population to be injected into the radio frequency ion trap, and supply an isolation waveform to the radio frequency ion trap. The isolation waveform can have at least one notch at a target mass-to-charge ratio, and a frequency profile determined to eject unwanted ions at a plurality of frequencies in a substantially similar amount of time.

In various embodiments of the first aspect, the frequency profile can be determined by applying a waveform with flat frequency profile to calibrant ions in the radio frequency ion trap and identifying an amplitude required to eject ions at a plurality of mass-to-charge ratios.

In various embodiments of the first aspect, the controller can be further configured to apply a time domain waveform amplitude gain to the isolation waveform. In particular embodiments, the time domain waveform amplitude gain can be determined by characterizing the dependence of amplitude versus mass-to-charge at a reference q value.

In various embodiments of the first aspect, the isolation waveform can include a plurality of notches at a plurality of target mass-to-charge ratios. In various embodiments, each of the plurality of notches can have a width determined to exceed a threshold isolation efficiency for the corresponding target mass-to-charge ratio.

In various embodiments of the first aspect, a frequency error correction can be applied to the location of the at least one notch within the isolation waveform.

In various embodiments of the first aspect, the isolation waveform can apply an excitation force to ions at a plurality of frequencies to eject unwanted ions in substantially the same amount of time.

In various embodiments of the first aspect, the frequency profile can be empirically determined to eject unwanted ions at a plurality of frequencies in the substantially the same amount of time.

In a second aspect, a method for determining a frequency profile for an isolation waveform used in a radio frequency ion trap in a mass spectrometer can include (1) supplying an ion population from a calibrant to be injected into the radio frequency ion trap, (2) applying a waveform having a flat frequency profile to the radio frequency ion trap, and (3) identifying ions of the ion population remaining in in the radio frequency ion trap. The ion population can have a plurality of ion species covering a range of mass-to-charge ratios. The method can further include (4) repeating steps (1)-(3) at increasing amplitudes of the waveform to identify an amplitude at which all the ions of a given ion species are ejected from the radio frequency ion trap for each ion species of the ion population and (5) characterizing the frequency profile for the radio frequency ion trap based on the amplitudes at which all the ions of a given ion species are ejected from the radio frequency ion trap.

In various embodiments of the second aspect, the method can further include repeating steps (1)-(4) at multiple trapping radio frequency amplitude levels to cover a range of possible frequencies.

In various embodiments of the second aspect, the isolation waveform can apply an excitation force to ions at a plurality of frequencies to eject unwanted ions in substantially the same amount of time.

In various embodiments of the second aspect, the frequency profile can be a best fit to the amplitudes at which all the ions of a given ion species are ejected from the radio frequency ion trap. In particular embodiments, the frequency response profile can be determined by a segmented regression to a plurality of regions. In particular embodiments, the frequency response profile can be determined by a polynomial regression to one or more regions.

In various embodiments of the second aspect, the method can further include characterizing the dependence of amplitude versus mass-to-charge at a reference q value. In particular embodiments, characterizing the dependence of amplitude versus mass-to-charge at the reference q value can include (a) supplying an ion population from the calibrant to the radio frequency ion trap; (b) applying a waveform having the amplitude frequency profile to the radio frequency ion trap; (c) obtaining a spectra of the ions remaining within the radio frequency ion trap; (d) repeating steps (a)-(c) at increasing amplitudes of the waveform to identify an amplitude at which all unwanted ions are ejected from the radio frequency ion trap; and (e) repeating steps (a)-(d) at multiple trapping radio frequency levels to characterize the dependence of amplitude versus mass-to-charge at the reference q value. The waveform can have a notch at a target mass-to-charge ratio.

In a third aspect, a mass spectrometer can include a radio frequency ion trap, a storage device having data describing a frequency profile stored therein, and a controller. The frequency response profile can have been determined to eject unwanted ions substantially simultaneously. The controller can be configured to cause an ion population to be injected into the radio frequency ion trap, and supply an isolation waveform to the radio frequency ion trap. The isolation waveform can have at least one notch at a target mass-to-charge ratio and a frequency profile based on the data.

In various embodiments of the third aspect, the frequency profile can be determined by applying a waveform with flat frequency profile to calibrant ions in the radio frequency ion trap and increasing voltage to identify an amplitude required to eject ions at a plurality of mass-to-charge ratios.

In various embodiments of the third aspect, the controller can be further configured to apply a time domain waveform amplitude gain to the isolation waveform. In particular embodiments, the time domain waveform amplitude gain can be determined by characterizing the dependence of amplitude versus mass-to-charge at a reference q value. In particular embodiments the dependence of amplitude versus mass-to-charge at a reference q value can be stored by the storage device.

In various embodiments of the third aspect, the isolation waveform can include a plurality of notches at a plurality of target mass-to-charge ratios. In particular embodiments, each of the plurality of notches can have a width determined to exceed a threshold isolation efficiency for the corresponding target mass-to-charge ratio.

In various embodiments of the third aspect, a frequency error correction can be applied to the location of the at least one notch within the isolation waveform.

In various embodiments of the third aspect, the isolation waveform can apply an excitation force to ions at a plurality of frequencies to eject unwanted ions in substantially the same amount of time.

In various embodiments of the third aspect, the frequency profile can be empirically determined to eject unwanted ions at a plurality of frequencies in substantially the same amount of time.

DRAWINGS

For a more complete understanding of the principles disclosed herein, and the advantages thereof, reference is now made to the following descriptions taken in conjunction with the accompanying drawings, in which.

Figure 1:
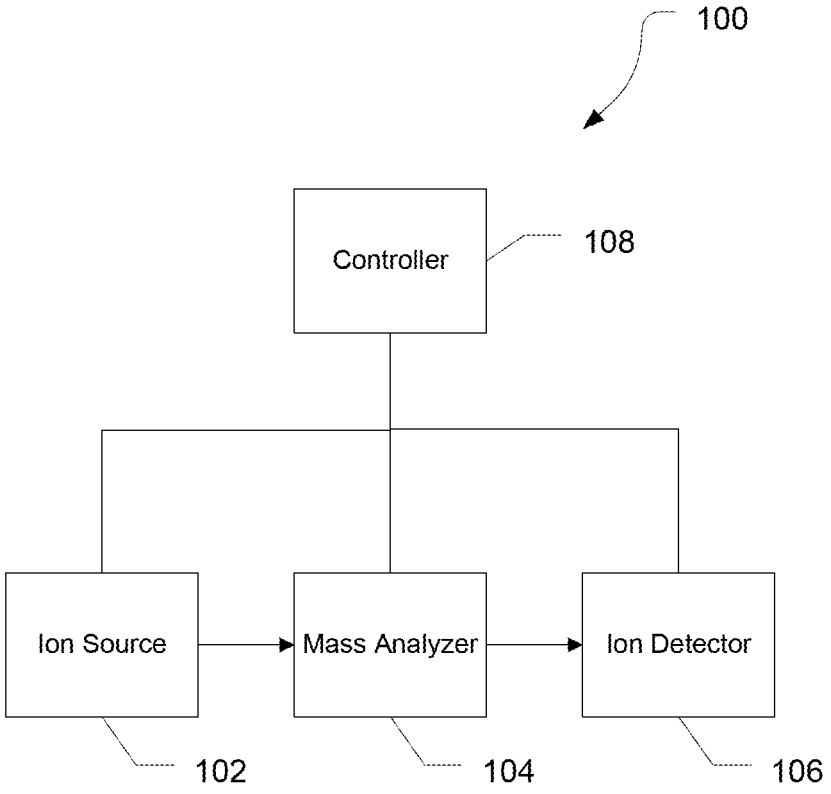
FIG. 1 is a block diagram of an exemplary mass spectrometry system, in accordance with various embodiments.

It is to be understood that the figures are not necessarily drawn to scale, nor are the objects in the figures necessarily drawn to scale in relationship to one another. The figures are depictions that are intended to bring clarity and understanding to various embodiments of apparatuses, systems, and methods disclosed herein. Wherever possible, the same reference numbers will be used throughout the drawings to refer to the same or like parts. Moreover, it should be appreciated that the drawings are not intended to limit the scope of the present teachings in any way.

DESCRIPTION OF VARIOUS EMBODIMENTS

Embodiments of systems and methods for ion isolation are described herein.

The section headings used herein are for organizational purposes only and are not to be construed as limiting the described subject matter in any way.

In this detailed description of the various embodiments, for purposes of explanation, numerous specific details are set forth to provide a thorough understanding of the embodiments disclosed. One skilled in the art will appreciate, however, that these various embodiments may be practiced with or without these specific details. In other instances, structures and devices are shown in block diagram form. Furthermore, one skilled in the art can readily appreciate that the specific sequences in which methods are presented and performed are illustrative and it is contemplated that the sequences can be varied and still remain within the spirit and scope of the various embodiments disclosed herein.

All literature and similar materials cited in this application, including but not limited to, patents, patent applications, articles, books, treatises, and internet web pages are expressly incorporated by reference in their entirety for any purpose. Unless described otherwise, all technical and scientific terms used herein have a meaning as is commonly understood by one of ordinary skill in the art to which the various embodiments described herein belongs.

It will be appreciated that there is an implied "about" prior to the temperatures, concentrations, times, pressures, flow rates, cross-sectional areas, etc. discussed in the present teachings, such that slight and insubstantial deviations are within the scope of the present teachings. In this application, the use of the singular includes the plural unless specifically stated otherwise. Also, the use of "comprise", "comprises", "comprising", "contain", "contains", "containing", "include", "includes", and "including" are not intended to be limiting. It is to be understood that both the foregoing general description and the following detailed description are exemplary and explanatory only and are not restrictive of the present teachings.

As used herein, "a" or "an" also may refer to "at least one" or "one or more." Also, the use of "or" is inclusive, such that the phrase "A or B" is true when "A" is true, "B" is true, or both "A" and "B" are true. Further, unless otherwise required by context, singular terms shall include pluralities and plural terms shall include the singular.

A "system" sets forth a set of components, real or abstract, comprising a whole where each component interacts with or is related to at least one other component within the whole.

Mass Spectrometry Platforms

Various embodiments of mass spectrometry platform 100 can include components as displayed in the block diagram of FIG. 1. In various embodiments, elements of FIG. 1 can be incorporated into mass spectrometry platform 100. According to various embodiments, mass spectrometer 100 can include an ion source 102, a mass analyzer 104, an ion detector 106, and a controller 108.

In various embodiments, the ion source 102 generates a plurality of ions from a sample. The ion source can include, but is not limited to, a matrix assisted laser desorption/ionization (MALDI) source, electrospray ionization (ESI) source, atmospheric pressure chemical ionization (APCI) source, atmospheric pressure photoionization source (APPI), inductively coupled plasma (ICP) source, electron ionization source, chemical ionization source, photoionization source, glow discharge ionization source, thermospray ionization source, and the like.

In various embodiments, the mass analyzer 104 can separate ions based on a mass to charge ratio of the ions. For example, the mass analyzer 104 can include a quadrupole mass filter analyzer, a quadrupole ion trap analyzer, a time-of-flight (TOF) analyzer, an electrostatic trap (e.g., Orbitrap) mass analyzer, Fourier transform ion cyclotron resonance (FT-ICR) mass analyzer, and the like. In various embodiments, the mass analyzer 104 can also be configured to fragment the ions using collision induced dissociation (CID) electron transfer dissociation (ETD), electron capture dissociation (ECD), photo induced dissociation (PID), surface induced dissociation (SID), and the like, and further separate the fragmented ions based on the mass-to-charge ratio.

In various embodiments, the ion detector 106 can detect ions. For example, the ion detector 106 can include an electron multiplier, a Faraday cup, and the like. Ions leaving the mass analyzer can be detected by the ion detector. In various embodiments, the ion detector can be quantitative, such that an accurate count of the ions can be determined.

In various embodiments, the controller 108 can communicate with the ion source 102, the mass analyzer 104, and the ion detector 106. For example, the controller 108 can configure the ion source or enable/disable the ion source. Additionally, the controller 108 can configure the mass analyzer 104 to select a particular mass range to detect. Further, the controller 108 can adjust the sensitivity of the ion detector 106, such as by adjusting the gain. Additionally, the controller 108 can adjust the polarity of the ion detector 106 based on the polarity of the ions being detected. For example, the ion detector 106 can be configured to detect positive ions or be configured to detected negative ions.

Calibration Methods

Figure 2:
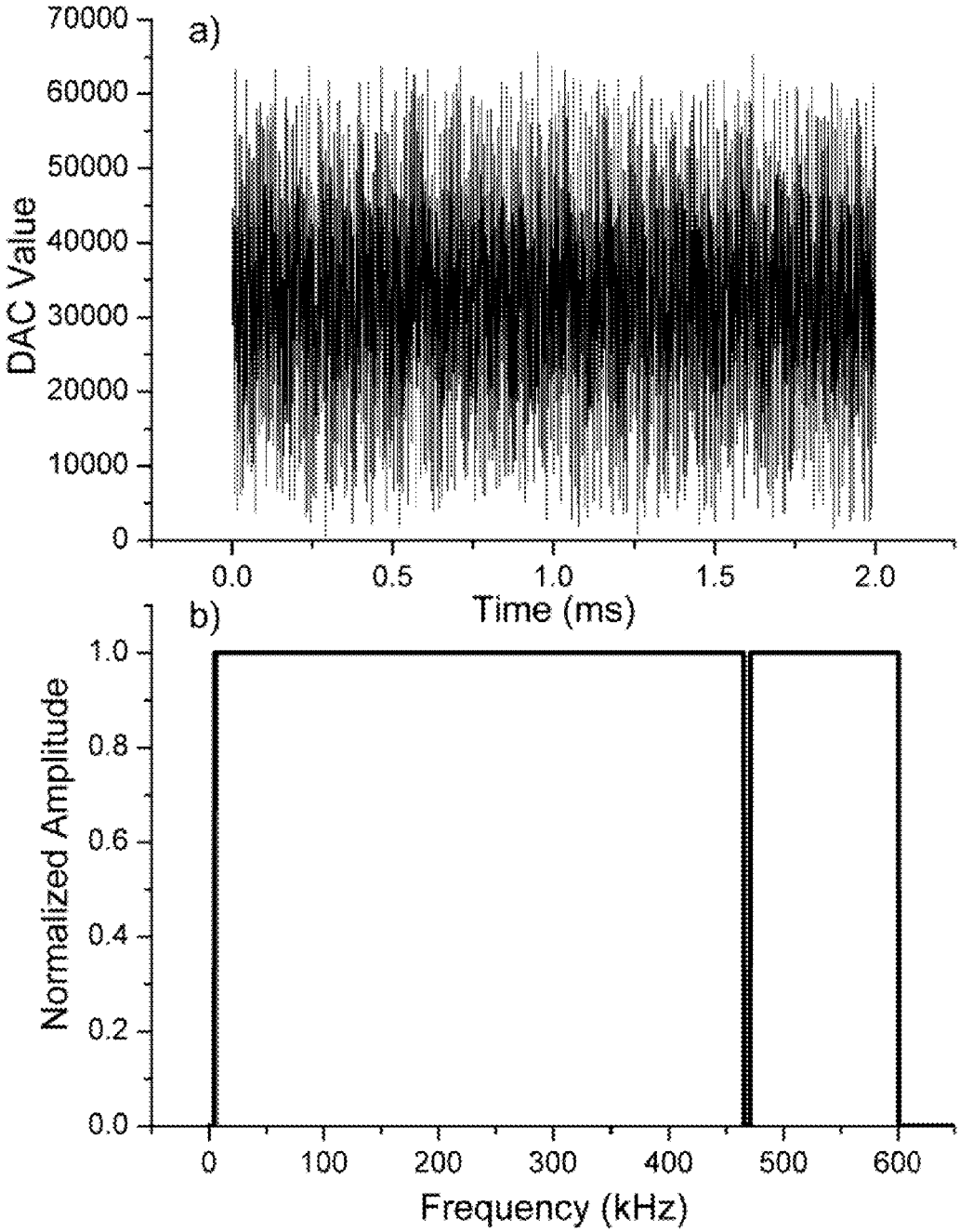
FIG. 2 is an illustration of an exemplary isolation waveform, in accordance with various embodiments.

Ion isolation is the process of removing unwanted or interfering ions from a sample being analyzed, while retaining ions that are desired for further processing and or analysis. In ion traps utilizing nominally quadrupole potentials, the isolation of ions can be achieved by the application of broadband supplementary ac waveforms containing energy at the oscillation frequencies of the unwanted or interfering ions and no energy at the oscillation frequencies of the precursor ions, forming a "notch". FIG. 2 shows an exemplary isolation waveform with a notch around 475 kHz. The isolation waveform has a constant amplitude and can apply a similar force on all ions to be ejected. However, larger ions can have greater inertia than smaller ions and react more slowly to the similar applied force.

It can be desirable for the isolation waveform to eject unwanted ions of multiple m/z at their respective q (or frequency) values in substantially the same amount of time. This can be especially important when ion isolation is to be performed simultaneously for multiple precursors, since an inappropriate waveform frequency response can lead to irregular isolation efficiency as a function of precursor oscillation frequency (i.e. m/z), and/or other complications. A description of an optimal waveform frequency profile and a method for determining the optimal waveform frequency profile are described herein. The benefits can include optimized isolation efficiency at multiple ion oscillation frequencies simultaneously and simplification of the global waveform amplitude scaling.

Figure 3:
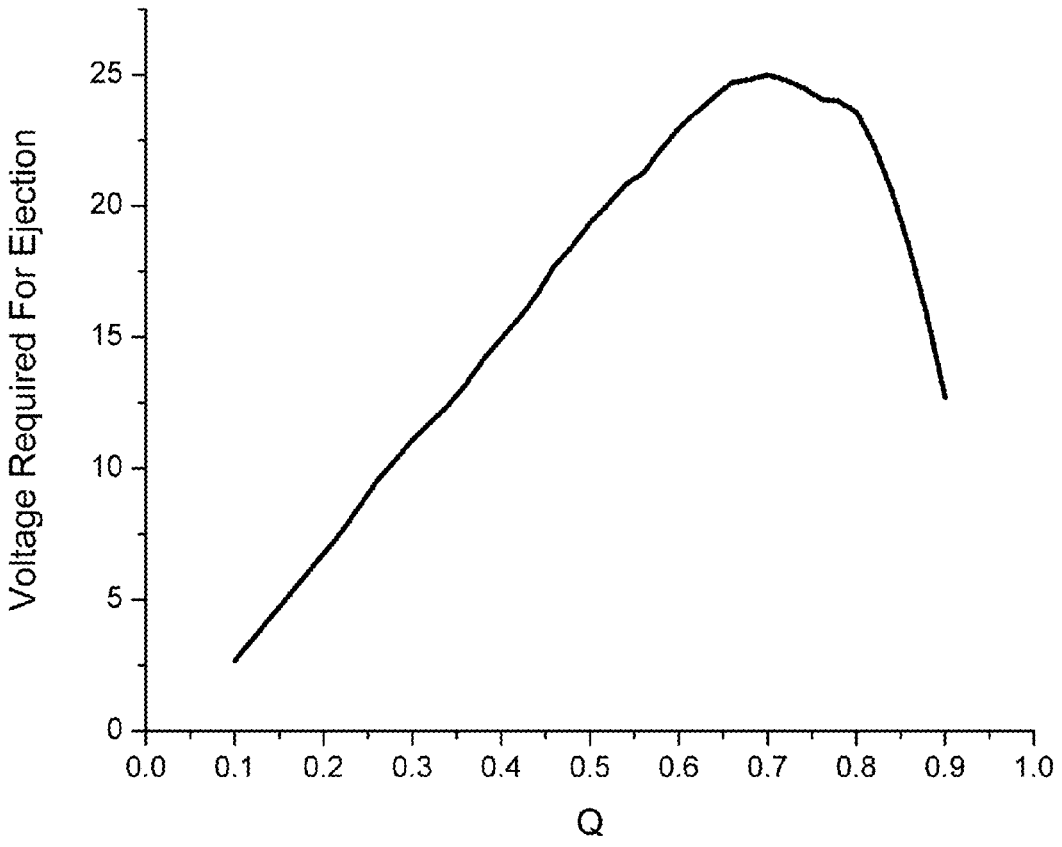
FIG. 3 is an illustration of a voltage required for ejection of Cesium ion as a function of q value.

The optimum frequency response of the waveform can take into account two factors; the strength of the trapping force as a function of Mathieu q, and the voltage required to eject an ion in a given amount of time as a function of m/z. The trapping force as a function of q for a particular m/z can be determined experimentally by selecting a precursor species, adjusting the trapping voltage V to give the precursor a particular q value, applying an ac excitation signal having a frequency component at this q, iterating over a range of excitation amplitudes, and for each q determining the amplitude at which the precursor is expelled from the trap. The precursor can be an atomic species such as $Cs^+$ which cannot dissociate and complicate analysis. The results of this experiment are shown in the FIG. 3. Cook's paper (Analytical Chemistry, Vol. 66, pg. 2488, 1994) suggests that the frequency response of the waveform should follow the Dehmelt pseudopotential well model, which is linear, and only valid over the range q, [0,0.40]. The data in FIG. 3 confirm the validity of the pseudopotential model over that range of q values, however this experiment only gives the voltage required to eject $Cs^+$, which has m/z 132. For simultaneous ejection of all unwanted species, each unwanted ion in the trap has a similar frequency response (q is related to frequency), but scaled proportionally to its respective m/z value. Thus an optimal scaling of the waveform as a function of q could be given as, $$A(q) = D(q)\frac{\alpha}{q} \qquad \text{Equation 1}$$

Figure 4A:
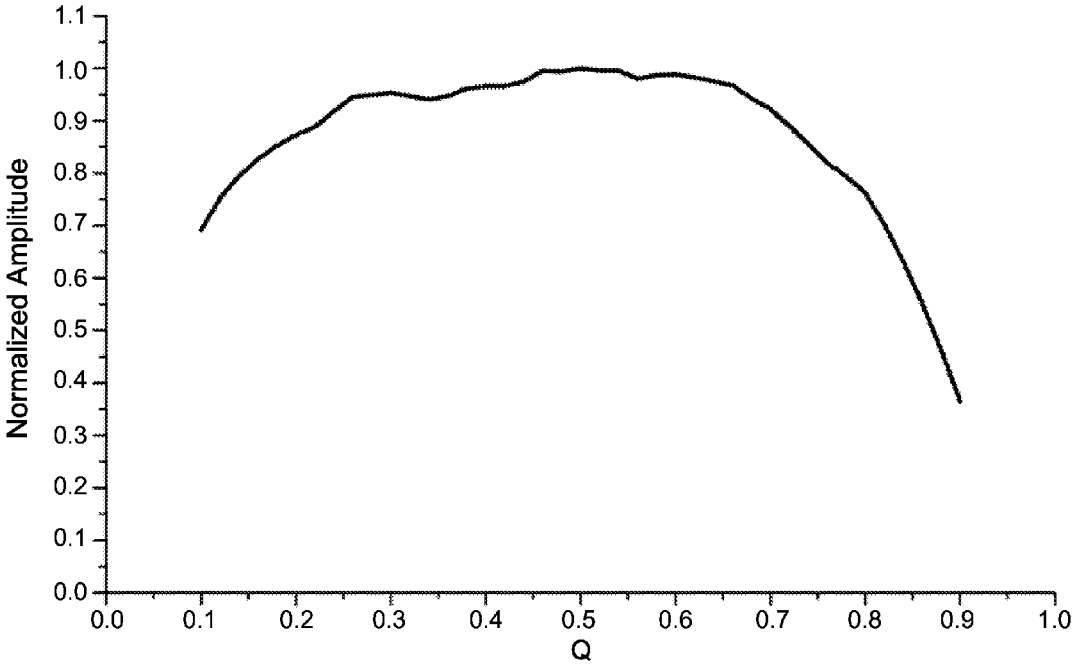
FIGS. 4A and 4B are illustrations of an amplitude required to simultaneously eject ions at all Mathieu q (4A) and frequency values (4B) derived from the ejection of a Cesium ion.
Figure 4B:
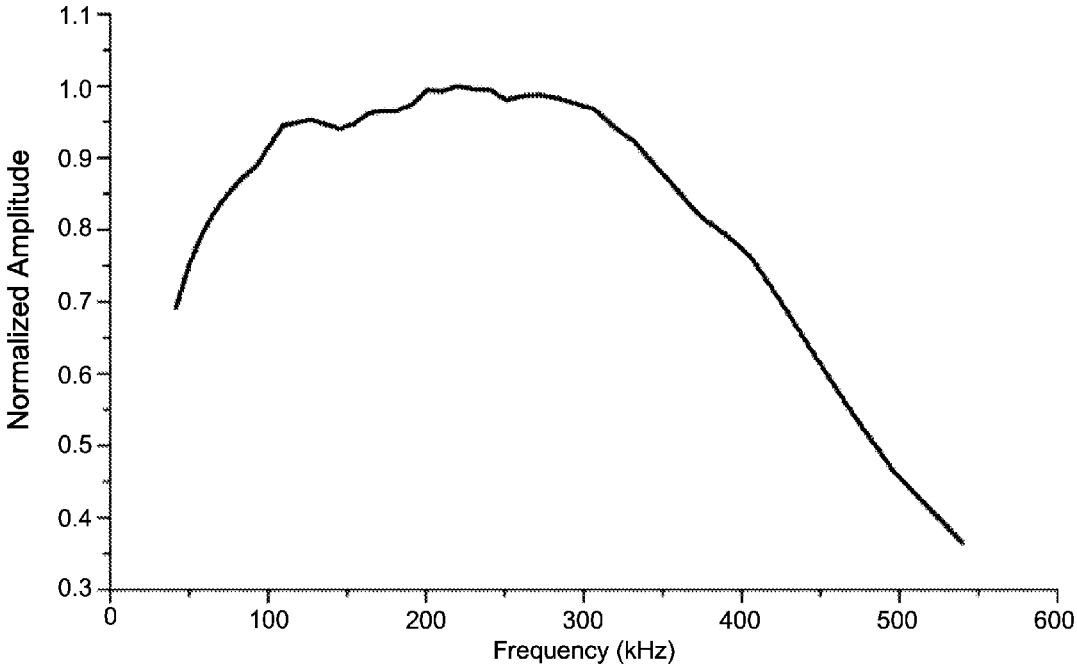

FIG. 4A shows a theoretical calculation of the amplitude of the waveform required to simultaneously eject ions at all q values. FIG. 4B shows a theoretical calculation of the amplitude of the waveform required to simultaneously eject ions at all frequency values. The values are derived using Equation 1 and the data from the experimental determination of the voltage required for ejection of Cesium ions shown in FIG. 3.

Figure 5:
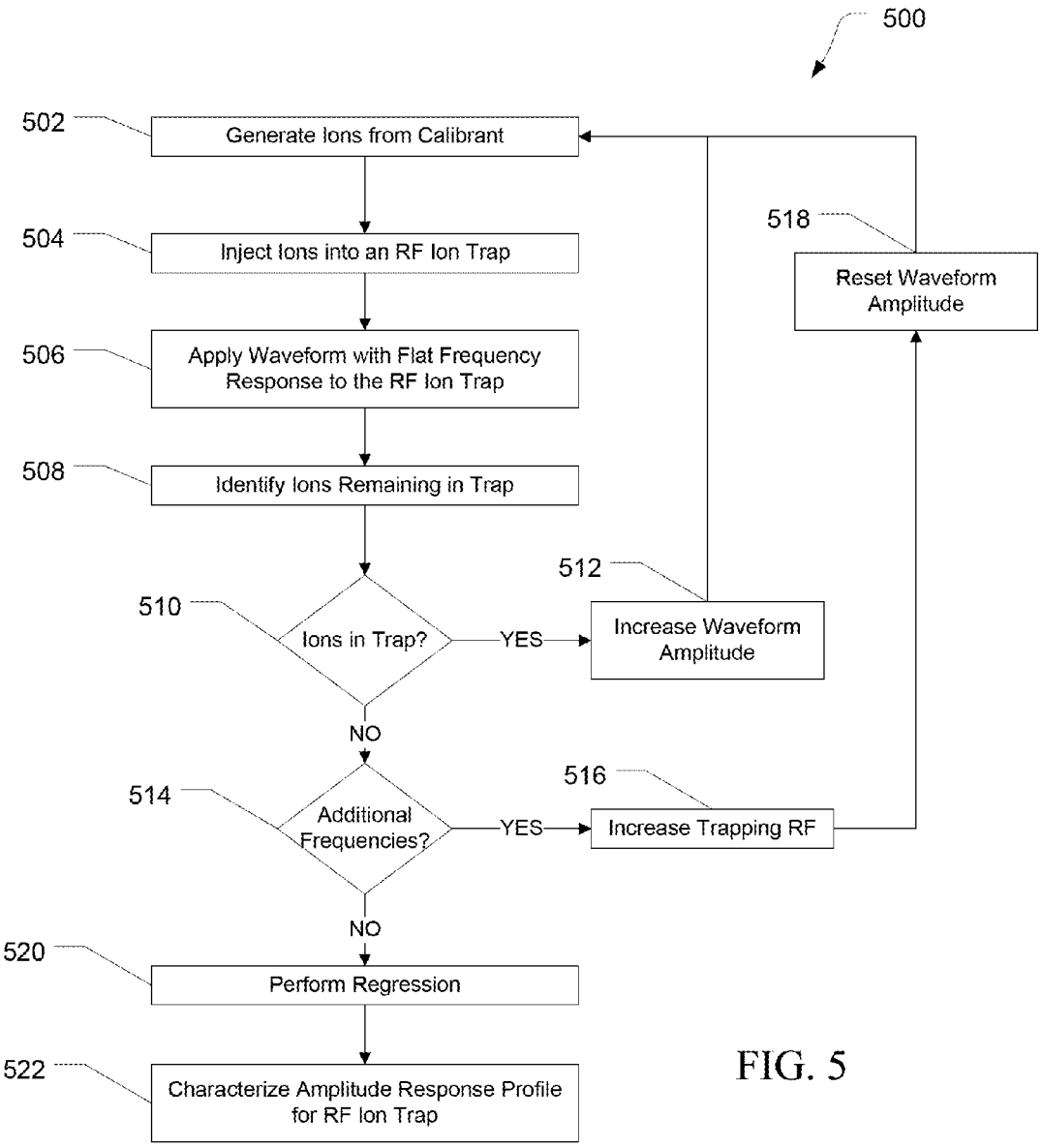
FIG. 5 is a flow diagram illustrating an exemplary method for characterizing a frequency profile of a radio frequency (RF) ion trap, in accordance with various embodiments.

While this experiment is instructive, and the frequency profile in FIG. 4 could be a candidate for the waveform frequency profile, another way of determining an optimal waveform frequency profile gives the optimal relation in one basic step, without making any assumptions or requiring additional determination of the factor $\alpha$. FIG. 5 is a flow diagram of an exemplary method 500 of characterizing the optimal waveform frequency profile for an RF ion trap.

At 502, ions can be generated from a calibrant. In various embodiments, a plurality of ionic species of differing mass-to-charge (m/z) ratio can be generated by ionizing a calibrant containing one or more molecular species. In various embodiments, the sample can be provided by a gas chromatograph, a liquid chromatograph, direct application, or other means of supplying a sample to a mass spectrometer. The sample may be ionized by various methods including but not limited to MALDI, ESI, APCI, APPI, ICP, electron ionization, chemical ionization, photoionization, glow discharge ionization, thermospray ionization, and the like.

At 504, the ions can be injected into an RF ion trap. In various embodiments, the ions can be transported from an ion source to the RF ion trap by way of various ion guides, ion lenses, and the like. The RF ion trap can trap the ions within a quadrupolar potential.

At 506, a waveform with a flat frequency profile can be applied to the RF ion trap for a duration of time. The waveform can apply a substantially constant amount of energy at substantially all frequencies within a frequency range to ions in the RF ion trap. The waveform can be effective to eject ions having various m/z ratios from the trap.

At 508, ions remaining in the trap can be identified such as by detecting the ions as the ions are scanned out of the RF ion trap or by use of another mass analyzer, such as a time-of-flight analyzer, an electrostatic trap analyzer, or the like.

At 510, it can be determined if ions remained in the trap after the waveform was applied. If there were remaining ions, the amplitude of the waveform could be increased, as indicated at 512, and additional ions could be generated an injected into the ion trap, as indicated at 502 and 504. The process can be repeated until no detectable ions remain within the ion trap after application of the waveform.

Alternatively, if no detectable ions remain within the ion trap after application of the waveform, a determination can be made, at 514, if any additional frequencies are desired. In various embodiments, the ions generated from the calibrant span a range of m/z ratios, and depending on the trapping RF of the RF ion trap, those ions can span a range of oscillation frequencies. To cover a broad range of species, it can be useful to alter the trapping RF which can change the oscillation frequencies of the calibrant ions. Systematically changing the trapping RF can provide data covering a large range of oscillation frequencies in order to determine the optimal amplitude at various frequencies.

If additional frequencies are desired, the frequency of the trapping RF can be increased, as indicated at 516. Further, at 518, the amplitude of the waveform can be reset, and additional ions could be generated an injected into the ion trap, as indicated at 502 and 504. The process can be repeated until data covering a sufficiently broad range of frequencies can be collected to characterize the amplitude response profile of the RF ion trap.

Figure 6:
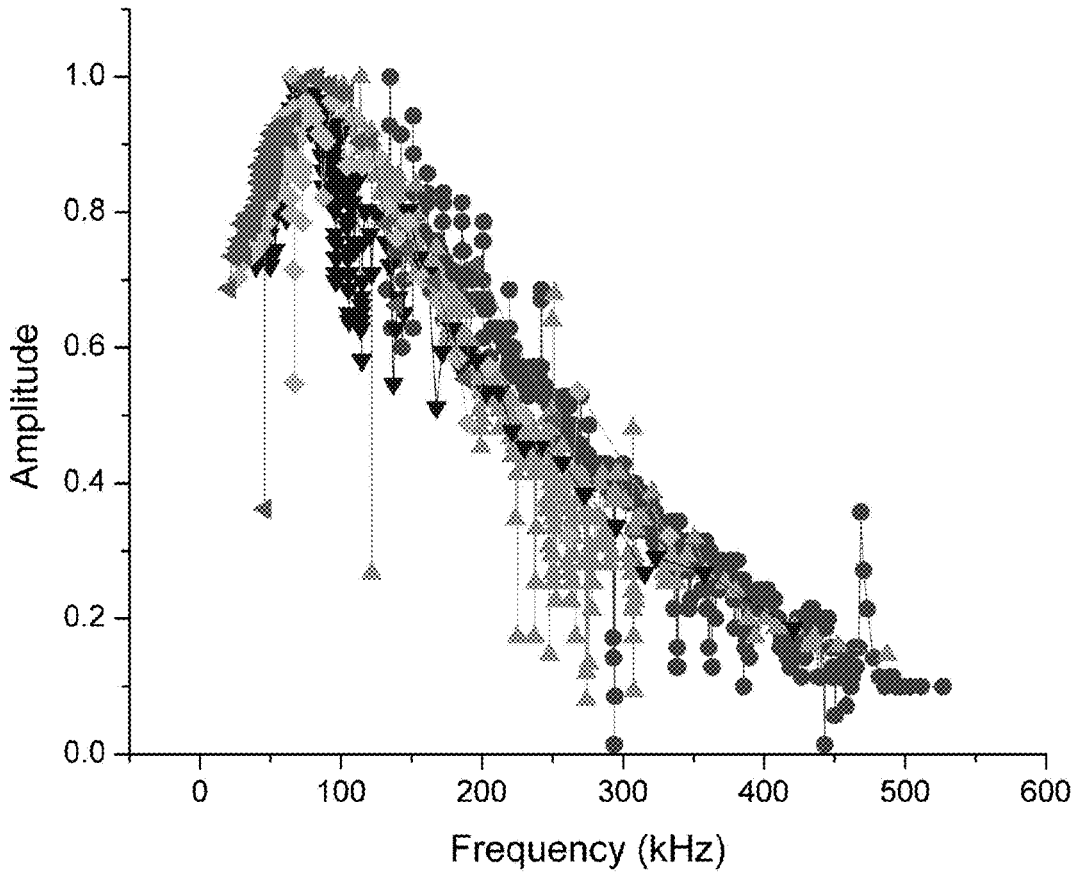
FIG. 6 is an illustration of a frequency profile for an exemplary RF ion trap, in accordance with various embodiments.

When no additional frequencies are desired, a regression of the data can be performed at 520. The data collected can be include information about a minimum voltage level at which all ions oscillating at a particular frequency (at a given m/z ratio in a given trapping field) are ejected from the RF ion trap during the duration of the waveform or in a substantially fixed amount of time. FIG. 6 shows a graph of exemplary data showing the relative amplitude of a square waveform needed to eject ions oscillating at various frequencies from an exemplary RF ion trap. In various embodiments, the regression can fit the minimum voltage as a function of oscillation frequency to a function. In various embodiments, the function can be determined by a segmented regression to a plurality of frequency regions. In various embodiments, the regression can be a polynomial regression or a linear regression to one or more regions.

Returning to FIG. 5, at 522, the frequency profile of the RF ion trap can be characterized based on the best fit function provided by the regression.

Figure 7:
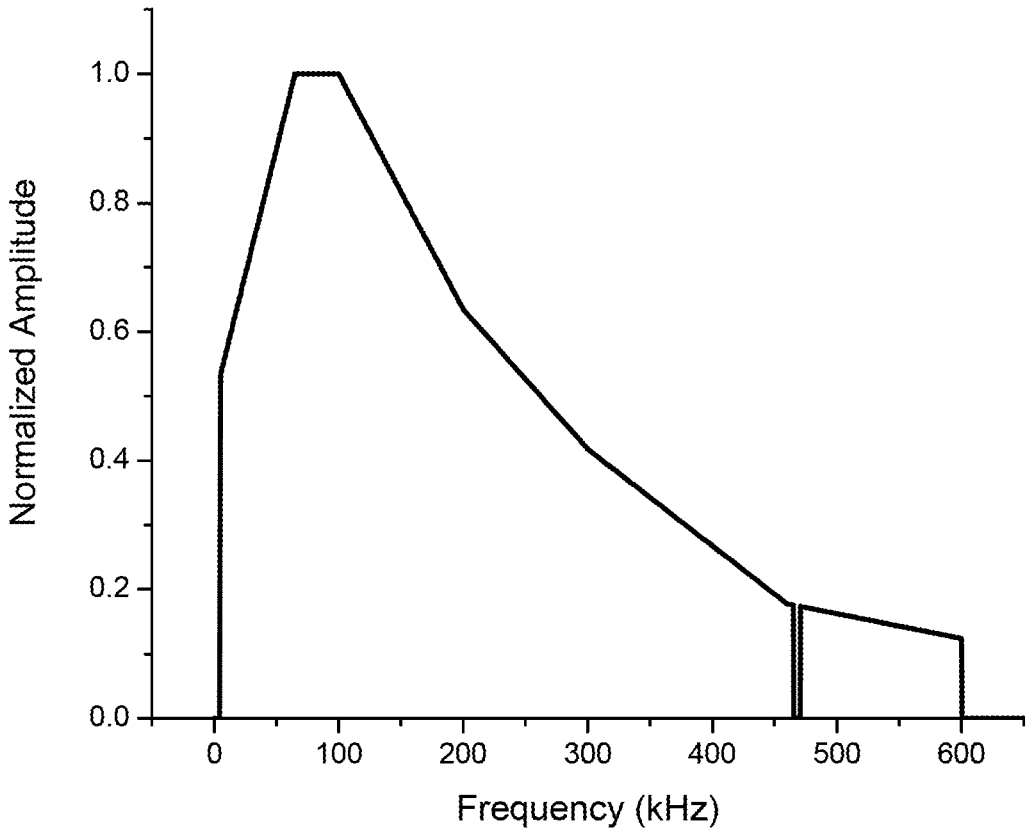
FIG. 7 is an illustration of an exemplary isolation waveform having a frequency profile for ejecting ions of multiple mass-to-charge ratios from an exemplary RF ion trap, in accordance with various embodiments.

FIG. 7 is an exemplary isolation waveform having a frequency profile corresponding to the data generated in accordance with method 500. The isolation waveform has frequency dependent amplitude that can apply an excitation force to unwanted ions at a plurality of frequencies such that they can be ejected in a substantially similar amount of time, such as substantially simultaneously. The exemplary isolation waveform includes a notch around 475 kHz, such that an excitation force is not applied to ions oscillating at about 475 kHz and they are not removed from the RF ion trap. In various embodiments, the time domain waveform amplitude of the exemplary isolation waveform may need to be adjusted by applying a scaling factor to achieve the desired ejection of unwanted ions.

In various embodiments, the optimized waveform frequency profile can simplify the calibration of the waveform amplitude mass dependence, that is, the waveform can be scaled by adjusting a time domain waveform amplitude. With a traditional waveform, the amplitude required to eject an ion has to be determined separately as a function of m/z at each q (or frequency). With an optimized waveform frequency response, the time domain waveform amplitude required to eject ions at any m/z can be determined as a function of m/z at a single reference q value. Simultaneous isolation of any arbitrary set of precursors can thereafter use the time domain amplitude scale factor required by the m/z at the reference q value. In practice, since ion isolation is typically most favorable at higher q values, calibration of the amplitude scale factor can performed at a highest $q_{ref}$, such as 0.86, to obtain the function $sq_{ref}(m/z)$ that gives the time domain waveform amplitude required to eject ions as a function of m/z.

Figure 8:
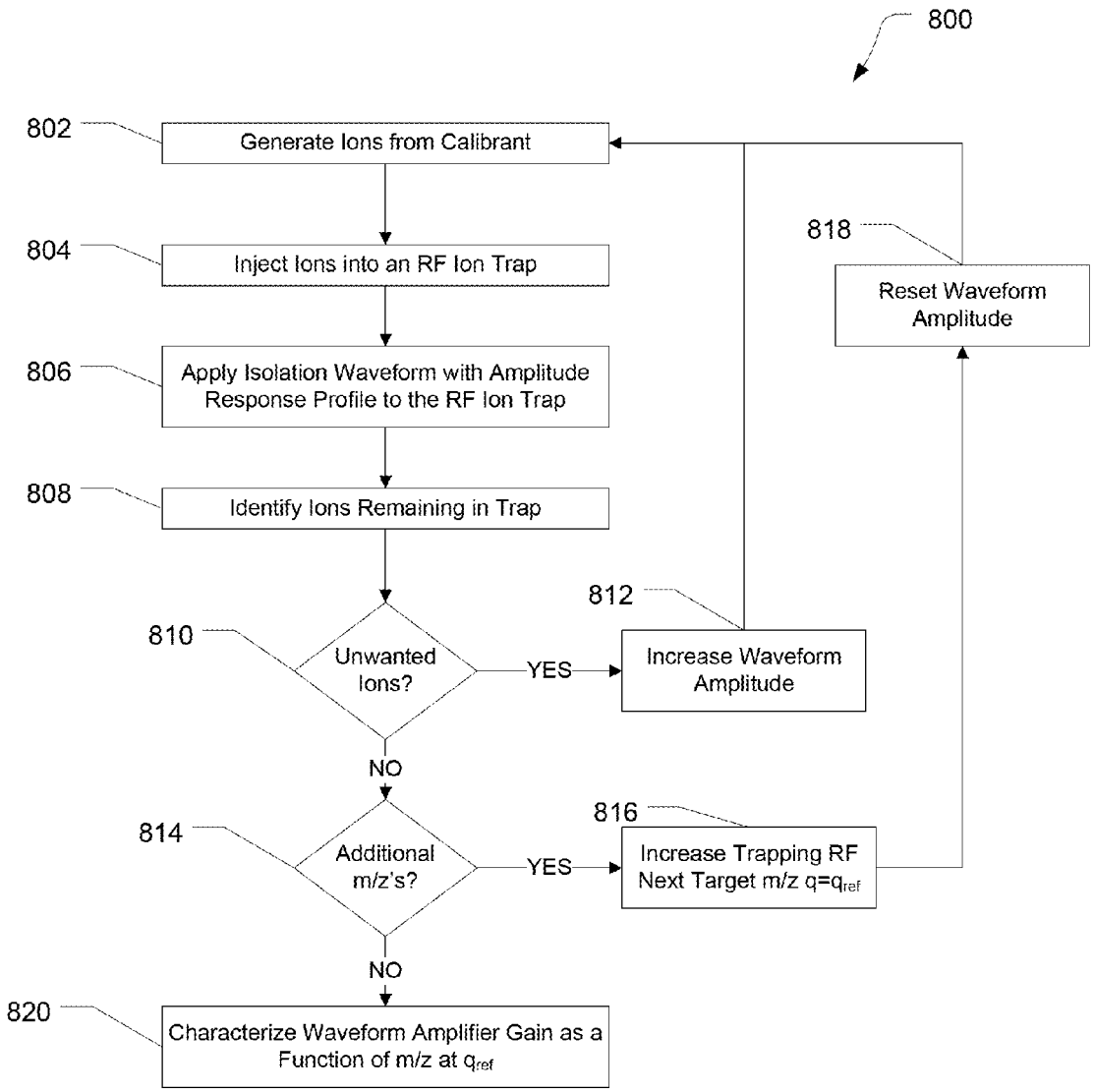
FIG. 8 is a flow diagram illustrating an exemplary method for characterizing a time domain waveform amplitude for an isolation waveform, in accordance with various embodiments.

FIG. 8 is a flow diagram of an exemplary method 800 of characterizing the time domain waveform amplitude for an RF ion trap.

At 802, ions can be generated from a calibrant, and at 804, the ions can be injected into an RF ion trap.

At 806, an isolation waveform with an optimal frequency profile, such as a frequency profile determined according to method 500, can be applied to the RF ion trap. In various embodiments, the RF trapping field can be such that $q=q_{ref}$ for a target ion, and the notch can be targets to the oscillation frequency of the target ions in the RF trapping field. The waveform can be applied to remove ions other than the target ions from the RF ion trap.

At 808, ions remaining in the trap can be identified such as by detecting the ions as the ions are scanned out of the RF ion trap or by use of another mass analyzer, such as a time-of-flight analyzer, an electrostatic trap analyzer, or the like.

At 810, it can be determined if unwanted ions (ions other than the target ions) remained in the trap after the waveform was applied. If there were remaining ions other than the target ions, the amplitude of the waveform can be increased, as indicated at 812, and additional ions could be generated an injected into the ion trap, as indicated at 802 and 804. The process can be repeated until no detectable ions other than the target ions remain within the ion trap after application of the waveform. The required amplitude to achieve this result can be indicative of a minimum time domain waveform amplitude needed for a particular m/z ratio (m/z ratio of the target ion) at a $q_{ref}$.

Alternatively, if no unwanted ions remain within the ion trap after application of the waveform, a determination can be made, at 814, if data for additional m/z ratios are desired. In various embodiments, the ions generated from the calibrant span a range of m/z ratios, and by adjusting the trapping RF values, data at a plurality of m/z ratios can be obtained.

If additional m/z ratios are desired, the frequency of the trapping RF can be increased such that $q=q_{ref}$ for the next calibrant ion species, as indicated at 816. Further, at 818, the amplitude of the waveform can be reset, and additional ions could be generated an injected into the ion trap, as indicated at 802 and 804. The process can be repeated until data covering a sufficiently broad range of m/z ratios can be collected to characterize the time domain waveform amplitude for the RF ion trap.

When no additional m/z ratios are desired, the time domain waveform amplitude as a function of m/z can be characterized for the RF ion trap based on the data collected, as indicated at 820.

Figure 9:
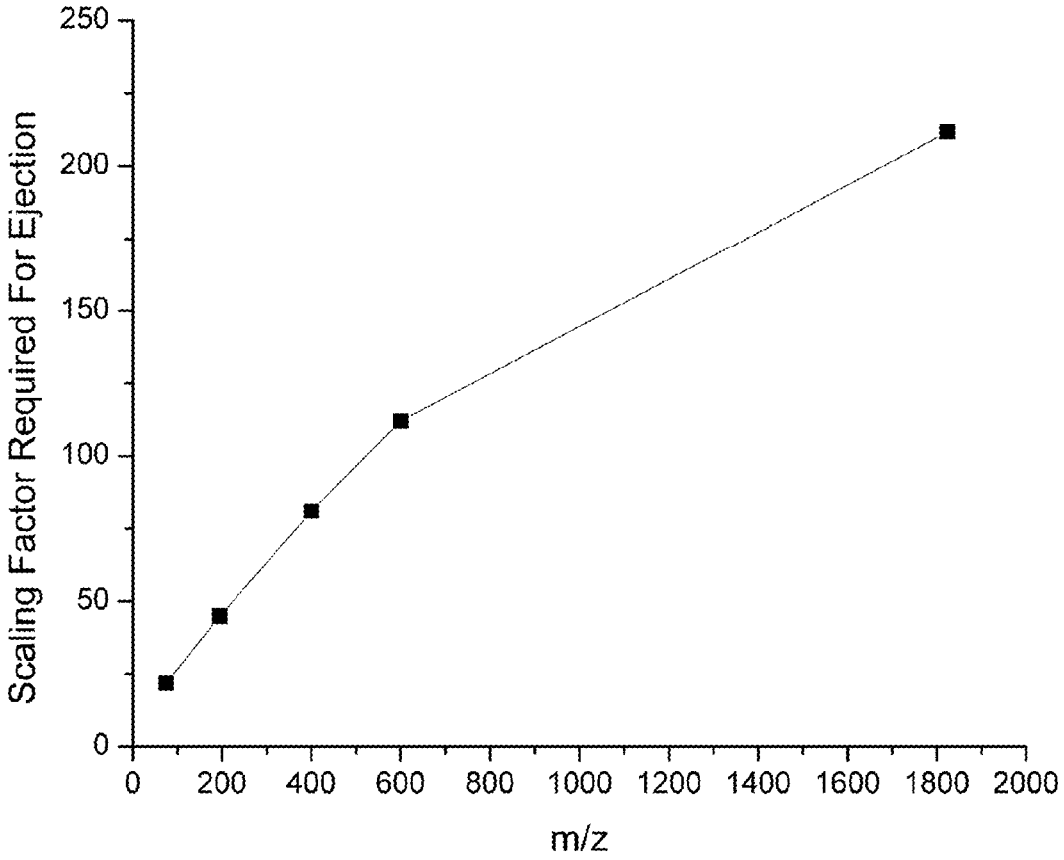
FIG. 9 is an illustration of an exemplary curve describing a time domain waveform amplitude as a function of mass-to-charge ratio, in accordance with various embodiments.

FIG. 9 shows a graph of exemplary data showing the time domain waveform amplitude as a function of m/z.

Ion Isolation Method

Figure 10:
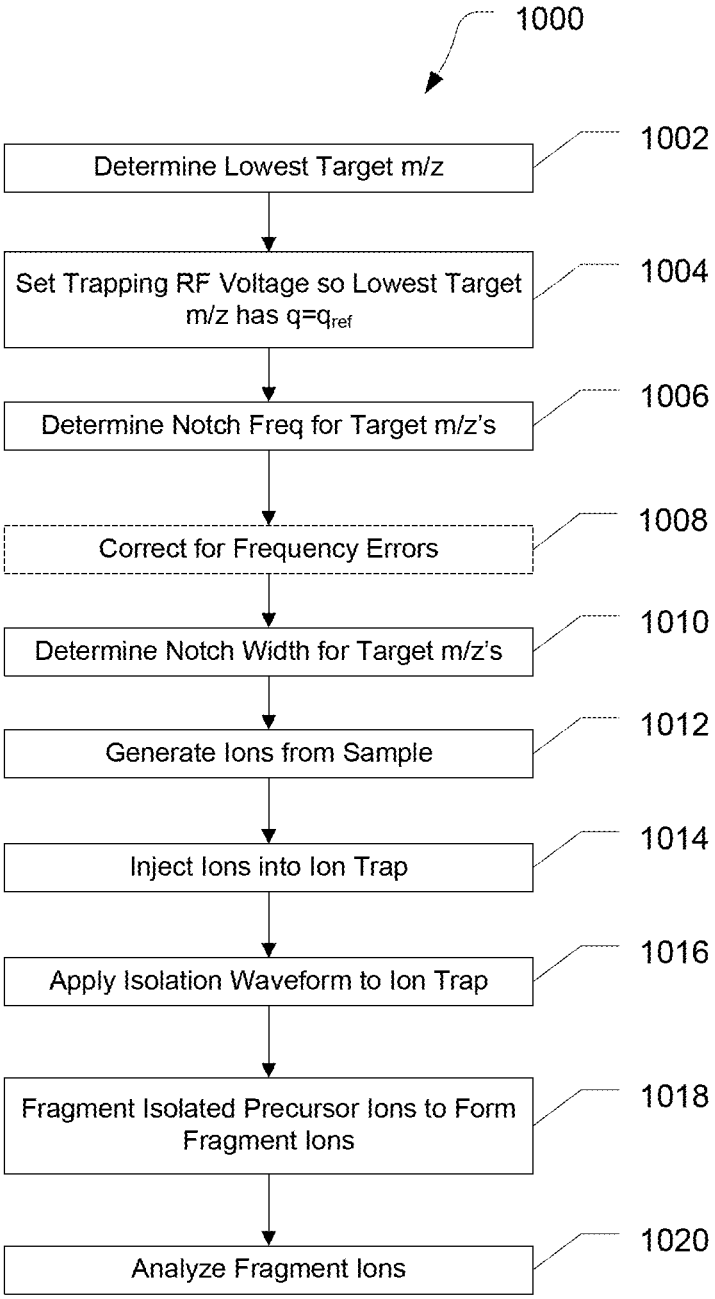
FIG. 10 is a flow diagram illustrating an exemplary method for isolating precursor ions using an isolation waveform, in accordance with various embodiments.

FIG. 10 is a flow diagram of an exemplary method 1000 for isolating target ions within an RF ion trap and analyzing the trapped target ions.

At 1002, the lowest target m/z can be determined for a set of target ions. In various embodiments, the set of target ions can include ions at a single m/z ratio or at a plurality of m/z ratios. When isolating target ions at a plurality of m/z ratios, an isolation waveform having multiple notches, one for each of the target ions, can be used.

At 1004, the trapping RF voltage can be set such that the lowest m/z ion in the set of target ions, $\min(m_i)$, has $q=q_{ref}$, such as $q_{ref}=0.86$. Additionally, the time domain waveform amplitude for the isolation waveform can be set to $s_{q_{ref}}(\min(m_i))$.

At 1006, notch frequencies can be determined for each of the target m/z ratios. The notch frequency can be a function of the trapping RF voltage and the target m/z.

In various embodiments, at 1008, the notch frequency can be adjusted to account for frequency errors. The effect of the frequency error can be greater in RF ion traps having greater non-linearity in the quadrupolar field, and trap with substantially linear fields may not require a frequency error correction. In various embodiments, the frequency error can be determined based on a previously determined calibration of frequency error, and can be a function of frequency. The calibration may be determined by applying a suitable isolation waveform and taking spectra that monitor the abundance of a certain m/z species for a series of trapping RF values that cause the precursor to be stepped through frequencies above, at, and below that of the isolation notch. The resulting data can produce a visualization of the isolation notch in what are sometimes termed "isolatograms". The error can be determined by the difference between the observed center of the isolatogram peak and the theoretical frequency determined for the target m/z ratio. In various embodiments, the error can be dependent on m/z ratio of the ion, amplitude of the trapping RF, space-charge density, distortions in the quadrupolar fields, and the like.

At 1010, notch widths can be determined for each of the target m/z ratios. The notch widths can be determined such that, for each notch, the isolation efficiency exceeds a threshold for the corresponding m/z ratio. In various embodiments, the notch width can be determined based on a previously determined calibration of notch width as a function of m/z and q. The calibration can be determined, for example, by increasing a notch width until the threshold isolation efficiency is achieved. This can be performed at a plurality of q values and m/z ratios, and may be performed on using calibrant ions.

At 1012, ions can be generated from a sample, and at 1014, the ions can be injected into an RF ion trap.

At 1016, an isolation waveform with an optimal frequency profile with a time domain waveform amplitude of $s_{q_{ref}}(\min(m_i))$ can be applied to the RF ion trap. The waveform can be applied to remove ions other than the target ions from the RF ion trap. In various embodiments, the frequency profile can be determined empirically, such as by method 500, to eject the unwanted ions at a plurality of frequencies in substantially the same amount of time. In various embodiments, the isolation waveform can apply an excitation force to unwanted ions at a plurality of frequencies to eject the unwanted ions in a substantially similar amount of time.

In various embodiments, as indicated at 1018, the isolated precursor ions can be fragmented to form ion fragments. In various embodiments, the precursor ions can be fragmented within the RF ion trap. In other embodiments, the precursor ions can be removed from the RF ion trap and fragmented, such as in a collision cell. In various embodiments, the isolated precursor ions can be removed to a storage device prior to fragmentation.

At 1020, the precursor ions can be analyzed to determine their m/z ratios, such as by detecting the ions as the ions are scanned out of the RF ion trap or by use of another analyzer, such as a time-of-flight analyzer, an electrostatic trap analyzer, or the like.

Computer-Implemented System

Figure 11:
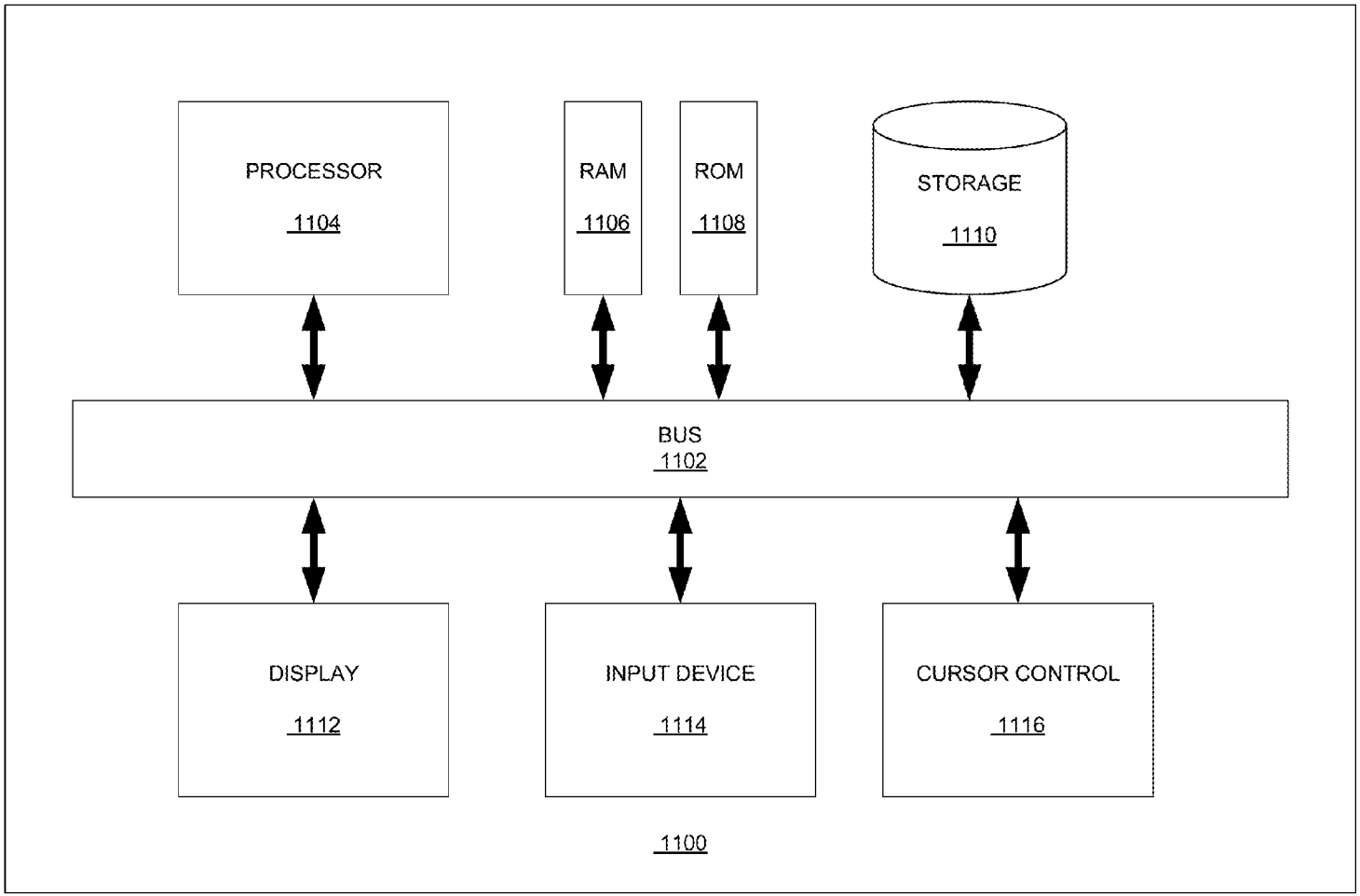
FIG. 11 is a block diagram illustrating an exemplary computer system.

FIG. 11 is a block diagram that illustrates a computer system 1100, upon which embodiments of the present teachings may be implemented as which may incorporate or communicate with a system controller, for example controller 108 shown in FIG. 1, such that the operation of components of the associated mass spectrometer may be adjusted in accordance with calculations or determinations made by computer system 1100. In various embodiments, computer system 1100 can include a bus 1102 or other communication mechanism for communicating information, and a processor 1104 coupled with bus 1102 for processing information. In various embodiments, computer system 1100 can also include a memory 1106, which can be a random access memory (RAM) or other dynamic storage device, coupled to bus 1102, and instructions to be executed by processor 1104. Memory 1106 also can be used for storing temporary variables or other intermediate information during execution of instructions to be executed by processor 1104. In various embodiments, computer system 1100 can further include a read only memory (ROM) 1108 or other static storage device coupled to bus 1102 for storing static information and instructions for processor 1104. A storage device 1110, such as a magnetic disk or optical disk, can be provided and coupled to bus 1102 for storing information and instructions.

In various embodiments, processor 1104 can include a plurality of logic gates. The logic gates can include AND gates, OR gates, NOT gates, NAND gates, NOR gates, EXOR gates, EXNOR gates, or any combination thereof. An AND gate can produce a high output only if all the inputs are high. An OR gate can produce a high output if one or more of the inputs are high. A NOT gate can produce an inverted version of the input as an output, such as outputting a high value when the input is low. A NAND (NOT-AND) gate can produce an inverted AND output, such that the output will be high if any of the inputs are low. A NOR (NOT-OR) gate can produce an inverted OR output, such that the NOR gate output is low if any of the inputs are high. An EXOR (Exclusive-OR) gate can produce a high output if either, but not both, inputs are high. An EXNOR (Exclusive-NOR) gate can produce an inverted EXOR output, such that the output is low if either, but not both, inputs are high.

TABLE 1

Logic Gates Truth Table

| INPUTS | | OUTPUTS | | | | | | |
|---|---|---|---|---|---|---|---|---|
| A | B | NOT A | AND | NAND | OR | NOR | EXOR | EXNOR |
| 0 | 0 | 1 | 0 | 1 | 0 | 1 | 0 | 1 |
| 0 | 1 | 1 | 0 | 1 | 1 | 0 | 1 | 0 |
| 1 | 0 | 0 | 0 | 1 | 1 | 0 | 1 | 0 |
| 1 | 1 | 0 | 1 | 0 | 1 | 0 | 0 | 1 |

One of skill in the art would appreciate that the logic gates can be used in various combinations to perform comparisons, arithmetic operations, and the like. Further, one of skill in the art would appreciate how to sequence the use of various combinations of logic gates to perform complex processes, such as the processes described herein.

In an example, a 1-bit binary comparison can be performed using a XNOR gate since the result is high only when the two inputs are the same. A comparison of two multi-bit values can be performed by using multiple XNOR gates to compare each pair of bits, and the combining the output of the XNOR gates using and AND gates, such that the result can be true only when each pair of bits have the same value. If any pair of bits does not have the same value, the result of the corresponding XNOR gate can be low, and the output of the AND gate receiving the low input can be low.

In another example, a 1-bit adder can be implemented using a combination of AND gates and XOR gates. Specifically, the 1-bit adder can receive three inputs, the two bits to be added (A and B) and a carry bit (Cin), and two outputs, the sum (S) and a carry out bit (Cout). The Cin bit can be set to 0 for addition of two one bit values, or can be used to couple multiple 1-bit adders together to add two multi-bit values by receiving the Cout from a lower order adder. In an exemplary embodiment, S can be implemented by applying the A and B inputs to a XOR gate, and then applying the result and Cin to another XOR gate. Cout can be implemented by applying the A and B inputs to an AND gate, the result of the A-B XOR from the SUM and the Cin to another AND, and applying the input of the AND gates to a XOR gate.

TABLE 2

1-bit Adder Truth Table

| INPUTS | | | OUTPUTS | |
|---|---|---|---|---|
| A | B | Cin | S | Cout |
| 0 | 0 | 0 | 0 | 0 |
| 1 | 0 | 0 | 0 | 1 |
| 0 | 1 | 0 | 0 | 1 |
| 1 | 1 | 0 | 1 | 0 |
| 0 | 0 | 1 | 0 | 1 |
| 1 | 0 | 1 | 1 | 0 |
| 0 | 1 | 1 | 1 | 0 |
| 1 | 1 | 1 | 1 | 1 |

In various embodiments, computer system 1100 can be coupled via bus 1102 to a display 1112, such as a cathode ray tube (CRT) or liquid crystal display (LCD), for displaying information to a computer user. An input device 1114, including alphanumeric and other keys, can be coupled to bus 1102 for communicating information and command selections to processor 1104. Another type of user input device is a cursor control 1116, such as a mouse, a trackball or cursor direction keys for communicating direction information and command selections to processor 1104 and for controlling cursor movement on display 1112. This input device typically has two degrees of freedom in two axes, a first axis (i.e., x) and a second axis (i.e., y), that allows the device to specify positions in a plane.

A computer system 1100 can perform the present teachings. Consistent with certain implementations of the present teachings, results can be provided by computer system 1100 in response to processor 1104 executing one or more sequences of one or more instructions contained in memory 1106. Such instructions can be read into memory 1106 from another computer-readable medium, such as storage device 1110. Execution of the sequences of instructions contained in memory 1106 can cause processor 1104 to perform the processes described herein. In various embodiments, instructions in the memory can sequence the use of various combinations of logic gates available within the processor to perform the processes describe herein. Alternatively hard-wired circuitry can be used in place of or in combination with software instructions to implement the present teachings. In various embodiments, the hard-wired circuitry can include the necessary logic gates, operated in the necessary sequence to perform the processes described herein. Thus implementations of the present teachings are not limited to any specific combination of hardware circuitry and software.

The term "computer-readable medium" as used herein refers to any media that participates in providing instructions to processor 1104 for execution. Such a medium can take many forms, including but not limited to, non-volatile media, volatile media, and transmission media. Examples of non-volatile media can include, but are not limited to, optical or magnetic disks, such as storage device 1110. Examples of volatile media can include, but are not limited to, dynamic memory, such as memory 1106. Examples of transmission media can include, but are not limited to, coaxial cables, copper wire, and fiber optics, including the wires that comprise bus 1102.

Common forms of non-transitory computer-readable media include, for example, a floppy disk, a flexible disk, hard disk, magnetic tape, or any other magnetic medium, a CD-ROM, any other optical medium, punch cards, paper tape, any other physical medium with patterns of holes, a RAM, PROM, and EPROM, a FLASH-EPROM, any other memory chip or cartridge, or any other tangible medium from which a computer can read.

In accordance with various embodiments, instructions configured to be executed by a processor to perform a method are stored on a computer-readable medium. The computer-readable medium can be a device that stores digital information. For example, a computer-readable medium includes a compact disc read-only memory (CD-ROM) as is known in the art for storing software. The computer-readable medium is accessed by a processor suitable for executing instructions configured to be executed.

In various embodiments, the methods of the present teachings may be implemented in a software program and applications written in conventional programming languages such as C, C++, etc.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

The embodiments described herein, can be practiced with other computer system configurations including hand-held devices, microprocessor systems, microprocessor-based or programmable consumer electronics, minicomputers, mainframe computers and the like. The embodiments can also be practiced in distributing computing environments where tasks are performed by remote processing devices that are linked through a network.

It should also be understood that the embodiments described herein can employ various computer-implemented operations involving data stored in computer systems. These operations are those requiring physical manipulation of physical quantities. Usually, though not necessarily, these quantities take the form of electrical or magnetic signals capable of being stored, transferred, combined, compared, and otherwise manipulated. Further, the manipulations performed are often referred to in terms, such as producing, identifying, determining, or comparing.

Any of the operations that form part of the embodiments described herein are useful machine operations. The embodiments, described herein, also relate to a device or an apparatus for performing these operations. The systems and methods described herein can be specially constructed for the required purposes or it may be a general purpose computer selectively activated or configured by a computer program stored in the computer. In particular, various general purpose machines may be used with computer programs written in accordance with the teachings herein, or it may be more convenient to construct a more specialized apparatus to perform the required operations.

Certain embodiments can also be embodied as computer readable code on a computer readable medium. The computer readable medium is any data storage device that can store data, which can thereafter be read by a computer system. Examples of the computer readable medium include hard drives, network attached storage (NAS), read-only memory, random-access memory, CD-ROMs, CD-Rs, CD-RWs, magnetic tapes, and other optical and non-optical data storage devices. The computer readable medium can also be distributed over a network coupled computer systems so that the computer readable code is stored and executed in a distributed fashion.

What is claimed is:

1. A mass spectrometer comprising:

an ion source configured to produce an ion population, the ion population including target ions within at least one target mass-to-charge ratio region and unwanted ions outside of the target mass-to-charge ratio regions;

a radio frequency ion trap; and a mass spectrometer controller configured to:

cause at least a portion of the ion population to be injected into the radio frequency ion trap; and apply an isolation waveform to the radio frequency ion trap to trap the target ions and eject the unwanted ions, the isolation waveform having a frequency profile with a frequency dependent amplitude to apply an excitation force to unwanted ions at a plurality of frequencies using a minimum voltage level at which all unwanted ions are ejected during the duration of the waveform or in a substantially fixed amount of time at each of the plurality of frequencies.

2. The mass spectrometer of claim 1, wherein the mass spectrometer controller is further configured to apply a waveform with flat frequency profile to calibrant ions in the radio frequency ion trap and identify an amplitude required to eject ions at a plurality of mass-to-charge ratios to empirically determine the frequency profile of the isolation waveform.

3. The mass spectrometer of claim 1, wherein the controller is further configured to apply a time domain waveform amplitude gain to the isolation waveform.

4. The mass spectrometer of claim 3, wherein the time domain waveform amplitude gain is based on a characterization of the dependence of amplitude versus mass-to-charge at a reference q value.

5. The mass spectrometer of claim 1, wherein the isolation waveform includes a plurality of notches at a plurality of target mass-to-charge ratios.

6. The mass spectrometer of claim 5, wherein each of the plurality of notches have a width necessary to exceed a threshold isolation efficiency for the corresponding target mass-to-charge ratio.

7. The mass spectrometer of claim 5, wherein a frequency error correction is applied to the location of at least one notch within the isolation waveform.

8. The mass spectrometer of claim 1, wherein the frequency profile is based on a characterization of the minimum energy needed to eject unwanted ions at a plurality of frequencies from the radio frequency trap in the fixed amount of time.

9. A mass spectrometer comprising:

an ion source configured to produce an ion population including target ions within at least one target mass-to-charge ratio region and unwanted ions outside of the target mass-to-charge ratio regions;

a storage device having data describing a frequency profile stored therein, the frequency response profile including a minimum voltage level at which all ions oscillating at a particular frequency are ejected from the RF ion trap during the duration of the waveform or in a substantially fixed amount of time for a plurality of frequencies; and a radio frequency ion trap configured to:

receive the ion population; and apply an isolation waveform to eject the unwanted ions of the ion population, the isolation waveform having at least one notch at the at least one target mass-to-charge ratio region, the isolation waveform having a frequency profile based on the data.

10. The mass spectrometer of claim 9, wherein the frequency profile is based on a characterization of an amplitude required to eject calibrant ions at a plurality of mass-to-charge ratios from the trap using a waveform with a flat frequency profile.

11. The mass spectrometer of claim 9, wherein the isolation waveform includes a time domain waveform amplitude gain.

12. The mass spectrometer of claim 11, wherein the time domain waveform amplitude gain is based on a characterization of the dependence of amplitude versus mass-to-charge at a reference q value.

13. The mass spectrometer of claim 12, wherein the storage device is configured to store the dependence of amplitude versus mass-to-charge at a reference q value .

14. The mass spectrometer of claim 9, wherein the isolation waveform includes a plurality of notches at a plurality of target mass-to-charge ratios.

15. The mass spectrometer of claim 14, wherein each of the plurality of notches have a width sufficient to exceed a threshold isolation efficiency for the corresponding target mass-to-charge ratio.

16. The mass spectrometer of claim 9, wherein a frequency error correction is applied to the location of the at least one notch within the isolation waveform.

17. The mass spectrometer of claim 9, wherein the isolation waveform applies an excitation force to ions at a plurality of frequencies to eject unwanted ions in substantially the same amount of time.

18. The mass spectrometer of claim 9, wherein the frequency profile is based on a characterization of the minimum energy necessary to eject unwanted ions at a plurality of frequencies in substantially the same amount of time.

* * * * *